United States Patent [19]

Gibson

[11] 3,982,861

[45] Sept. 28, 1976

[54] ROTOR CONSTRUCTION FOR SLANT AXIS ROTARY MECHANISMS

[75] Inventor: Myron R. Gibson, Edelstein, Ill.

[73] Assignee: Caterpillar Tractor Co., Peoria, Ill.

[22] Filed: Dec. 12, 1975

[21] Appl. No.: 640,083

[52] U.S. Cl. ..... 418/53

[51] Int. Cl.[2] ..... F04C 17/02

[58] Field of Search ..... 418/49, 50, 51, 52, 418/53

[56] References Cited

UNITED STATES PATENTS

| | | | |
|---|---|---|---|
| 410,308 | 9/1889 | Bowns | 418/53 |
| 442,401 | 12/1890 | Shaw | 418/51 |
| 615,392 | 12/1898 | Kelley | 418/53 |
| 1,797,491 | 3/1931 | Ahlberg | 418/53 |
| 3,485,218 | 12/1969 | Clarke | 418/53 |
| 3,942,384 | 3/1976 | Parker | 418/53 X |

FOREIGN PATENTS OR APPLICATIONS

| | | | |
|---|---|---|---|
| 600,295 | 10/1934 | Germany | 418/53 |

*Primary Examiner*—C. J. Husar
*Assistant Examiner*—Leonard Smith
*Attorney, Agent, or Firm*—Wegner, Stellman, McCord, Wiles & Wood

[57] ABSTRACT

An improved slant axis rotary mechanism of the type including a housing, a shaft journalled in the housing, an angularly offset portion on the shaft and a rotor journalled on the angularly offset portion. The angularly offset portion includes a peripheral thrust collar and the rotor is formed of two pieces which sandwich the thrust collar. One of the rotor pieces includes a central cavity spaced from the angularly offset portion and a plurality of bolts are within the cavity and secure the pieces of the rotor together.

4 Claims, 2 Drawing Figures

ROTOR CONSTRUCTION FOR SLANT AXIS ROTARY MECHANISMS

BACKGROUND OF THE INVENTION

This invention relates to slant axis rotary mechanisms used as engines, pumps, compressors or the like. More specifically, it relates to improvements in the fabrication of rotors in such mechanisms.

As is well known, slant axis rotary mechanisms include an angularly offset portion in their main shaft for journalling the rotor employed. Typically, a peripheral thrust collar will be disposed on the angularly offset portion. The presence of the thrust collar requires that either the shaft or the rotor be formed of two elements which are united during assembly such that the rotor sandwiches the thrust collar.

Ordinarily, the stresses encountered in the shaft are sufficiently high that it is made in one piece. Thus, the rotor is generally formed of two or more pieces. In state of the art constructions, one piece is threadably received by the other. The difficulty encountered with such a construction is the yielding of the screw threads which results in a loosening of the assembly and, in turn, causes portions of the rotor hub to rub against the housing. Moreover, it is difficult to machine the threads with the precision required. Relatively fine threads do not provide the requisite strength, while coarse threads present a great deal of friction during assembly so that it is difficult to unite the pieces with the desired degree of torque.

SUMMARY OF THE INVENTION

It is the principal object of the invention to provide a new and improved slant axis rotary mechanism such as an engine, pump, compressor or the like. More specifically, it is an object of the invention to provide an improved rotor construction in such a mechanism.

The exemplary embodiment of the invention achieves the foregoing object in a slant axis rotary mechanism including a housing, a shaft journalled in the housing and an angularly offset portion on the shaft. The angularly offset portion includes a peripheral thrust collar and a two-piece rotor is journalled on the angularly offset portion and sandwiches the thrust collar. The rotor has a spherical hub with a peripheral flange and one of the rotor pieces includes a central cavity spaced from the angularly offset portion. A plurality of angularly spaced bolts is disposed within the cavity and extend through the one rotor piece into the other and secure the pieces together.

According to a highly preferred embodiment, one of the pieces includes a bore receiving a portion of the other piece and the pieces are press fitted together in addition to being bolted together.

In a highly preferred embodiment, the hub of the rotor mounts piston seals at predetermined locations and the interface of the two rotor pieces extends through at least some of the predetermined locations to simplify the machining of the usual counterbores which receive such piston seals.

Other objects and advantages will become apparent from the following specification taken in conjunction with the accompanying drawings.

DESCRIPTION OF THE PREFERRED EMBODIMENT

Figure 1:
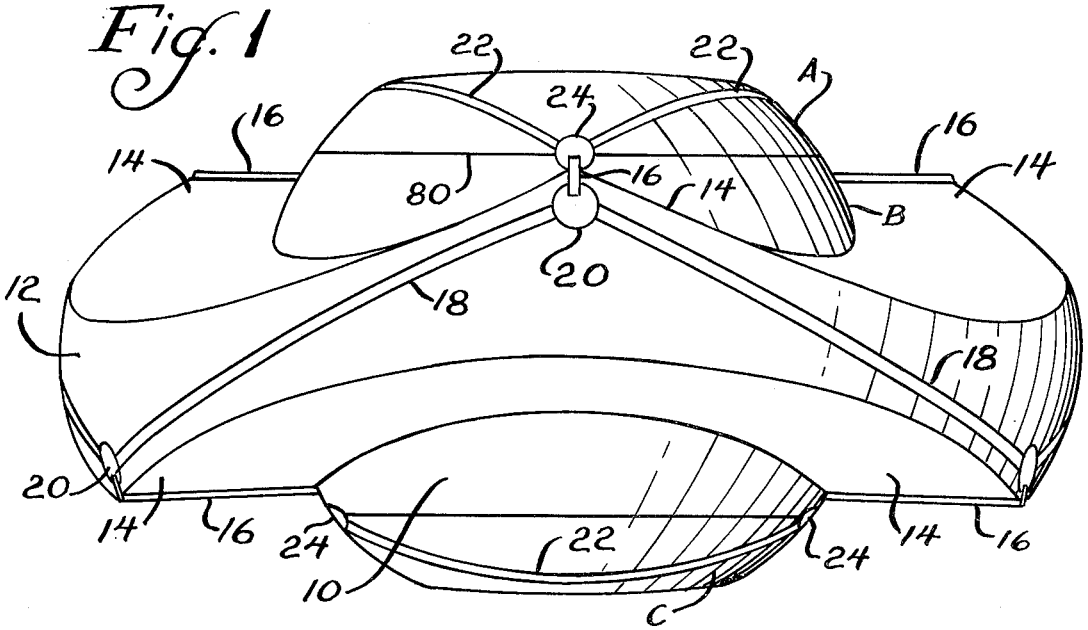
FIG. 1 is a perspective view of a rotor for a four-cycle slant axis rotary mechanism made according to the invention.

An exemplary embodiment of an improved rotor construction for a slant axis rotary mechanism is illustrated in FIG. 1. The rotor includes a generally spherical hub 10 and a peripheral, radially outwardly extending flange 12. The rotor illustrated in FIG. 1 is intended for use in a so-called four-cycle mechanism and, as a consequence, each side of the flange 12 will have three apices 14, each having a groove (not numbered) for receipt of a corresponding apex seal 16. The apices 14 on each side of the flange 12 are spaced at 120° intervals and they are staggered with respect to the apices on the opposite side of the flange 12.

The radially outer surface of the flange 12 carries peripheral seals 18 and at each apex 14, a piston seal 20 is provided to seal the intersection of the peripheral seals 18 and the apex seals 16 in a manner well known.

The hub 10 carries compression seals 22 which terminate in piston seals 24 carried by the hub 10 adjacent each apex 14 as illustrated.

As seen in FIG. 1, the rotor is formed of three pieces designated A, B and C. If desired, the pieces B and C or A and B could be combined into a single piece.

Figure 2:
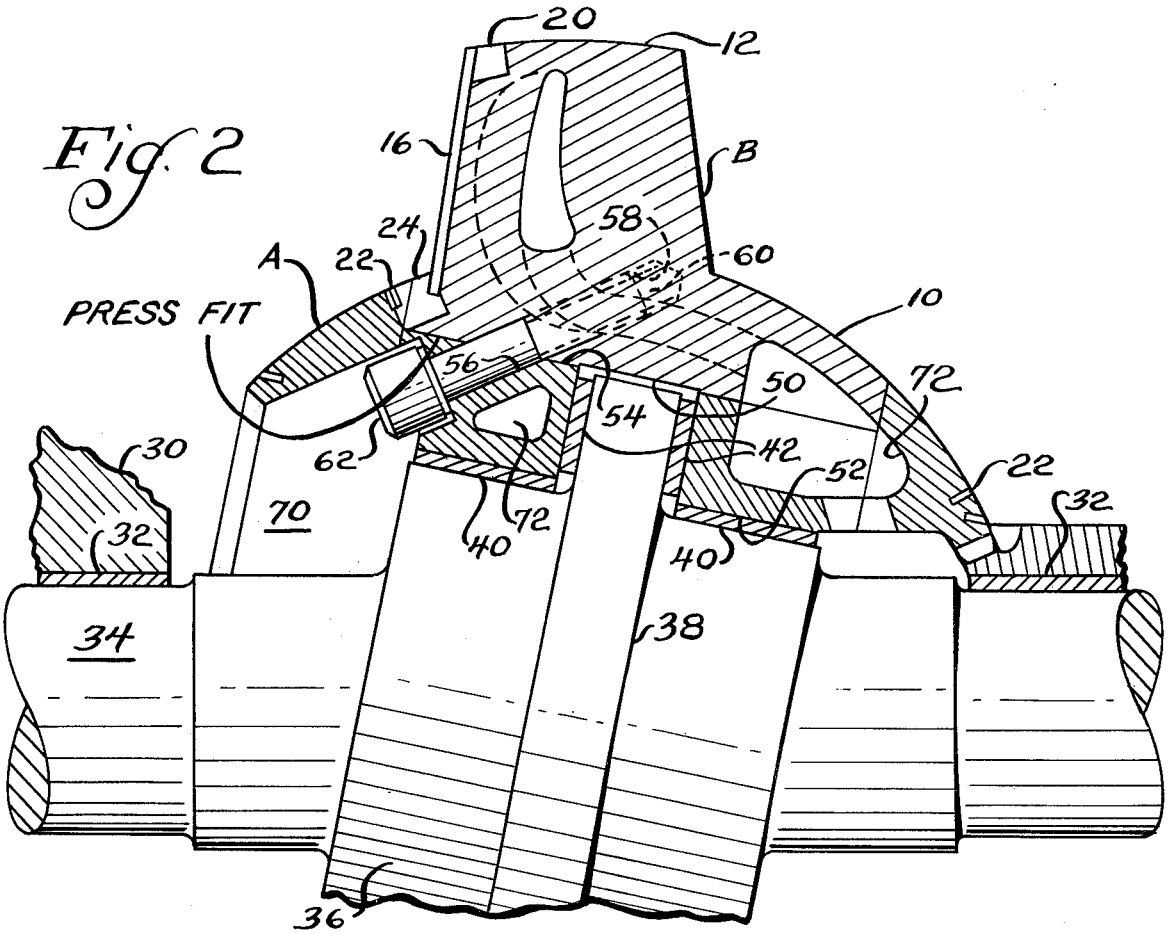
FIG. 2 is an enlarged, fragmentary, sectional view of a rotor.

Turning now to FIG. 2, the rotor and the mechanism in which it is used will be described in greater detail. The mechanism includes a housing, shown fragmentarily at 30 and bearings 32 therein journal a shaft 34. The shaft 34 includes an angularly offset portion 36 which, in turn, is provided with a peripheral, radially outwardly extending thrust collar 38. Journal bearings 40 are disposed on parts of the angularly offset portion 36 for journalling the rotor, as illustrated in FIG. 2, while thrust bearings are disposed about the thrust collar 38.

The rotor part B includes a central bore 50. One part 52 of the bore 50 is of a diameter to appropriately receive one of the journal bearings 40, while the remaining portion of the bore 50 is of a diameter at least equal to the diameter of the thrust collar 38 as illustrated. This is for the purpose of allowing the rotor part B to be fitted upon the angularly offset portion 36.

The rotor part A includes a cylindrical section 54 which is received in the enlarged portion of the bore 50. As noted in the drawing in FIG. 2, it is preferable that the relation be one of a press fit.

At equally angularly spaced locations, the rotor part A is provided with a plurality of bores 56 which align with bores 58 in the rotor piece B. The bore 58 is provided with threads for receipt of the threaded end 60 of a capscrew 62 or bolt. Thus, a plurality of capscrews 62 secure the rotor parts together.

In this connection, it will be observed that the rotor part A includes a central cavity 70 which is spaced from the angularly offset portion 36 of the shaft 34 to enable easy insertion of the capscrews 62. The structure is completed with suitable coolant passages 72.

It is to be noted that the cap screws may vary in length and may be at different angles to the axis of rotation of the rotor. If desired, unthreaded portions of the cap screws 62 may be relatively loose within the bores 56. In some instances, the unthreaded shank portions of the capscrews 62 may have a reduced cross section so that shank stresses are raised after assemblage without raising stresses at the threads within the bore 58. Alternately, the capscrews 62 may be body ground and the bores 58 reamed to provide a snug fit. Thus, assembled stresses are easily controlled by the variety of parameters which may be suitably varied to attain given characteristis.

It is also to be observed that the interface 80 of the rotor parts preferably extends through the locations at which the piston seals 24 are located. This permits the grooves which receive the hub seals 22 to be machined more easily, particularly when a three-part construction is employed.

What is claimed is:

1. In a slant axis rotary mechanism including a housing, a shaft journalled in the housing, an angularly offset portion on said shaft and including a peripheral thrust collar, and a two-piece rotor journalled on said angularly offset portion and sandwiching said thrust collar, said rotor having a spherical hub with a peripheral flange, the improvement wherein one of said rotor pieces includes a central cavity spaced from said angularly offset portion, and a plurality of angularly spaced bolts within said cavity and extending through said pieces to secure said pieces together.

2. The slant axis rotary mechanism of claim 1 wherein the other of said pieces includes a bore receiving a portion of said one piece, said pieces being press fitted together.

3. The slant axis rotary mechanism of claim 1 wherein said hub mounts piston seals at predetermined locations, the interface of said pieces extending through at least some of said predetermined locations.

4. The slant axis rotary mechanism of claim 1 wherein the other of said pieces includes a central bore, at least a portion of which is at least equal in diameter to said thrust collar, said one piece having an inner cylindrical section received in said bore portion, said bolts securing said pieces together at said cylindrical section and said bore portion.

* * * * *